US008978538B1

(12) United States Patent
Schaller

(10) Patent No.: US 8,978,538 B1
(45) Date of Patent: Mar. 17, 2015

(54) SECONDARY WEAPON MOUNT

(71) Applicant: Chris Schaller, Santa Ana, CA (US)

(72) Inventor: Chris Schaller, Santa Ana, CA (US)

( * ) Notice: Subject to any disclaimer, the term of this patent is extended or adjusted under 35 U.S.C. 154(b) by 0 days.

(21) Appl. No.: 14/013,022

(22) Filed: Aug. 28, 2013

Related U.S. Application Data

(60) Provisional application No. 61/693,989, filed on Aug. 28, 2012.

(51) Int. Cl.
*F41A 25/00* (2006.01)
*F41A 27/22* (2006.01)

(52) U.S. Cl.
CPC ..... *F41A 27/22* (2013.01)
USPC ..... 89/37.14; 89/37.03; 89/37.01

(58) Field of Classification Search
USPC ..... 89/37.14, 37.03, 37.01
See application file for complete search history.

(56) References Cited

U.S. PATENT DOCUMENTS 2,309,808 A * 2/1943 Trotter ..... 89/37.03
2,427,365 A * 9/1947 Meister ..... 269/152
3,115,062 A * 12/1963 Tassie et al. ..... 89/37.01
3,495,795 A * 2/1970 Brown ..... 248/230.5
3,863,542 A * 2/1975 Pierre et al. ..... 89/37.14
5,661,919 A * 9/1997 Pryor ..... 42/94
5,703,317 A * 12/1997 Levilly et al. ..... 89/37.03
6,338,218 B1 * 1/2002 Hegler ..... 42/94
7,210,391 B2 * 5/2007 Beckmann ..... 89/37.03
7,513,187 B1 * 4/2009 Lambermont ..... 89/37.07
7,770,505 B2 * 8/2010 McClellan et al. ..... 89/36.06
7,798,049 B2 * 9/2010 Willis, Jr. ..... 89/37.04
7,963,205 B1 * 6/2011 Brooks ..... 89/37.03
7,980,017 B2 * 7/2011 Harman, III ..... 42/94
8,069,767 B2 * 12/2011 Deckard et al. ..... 89/33.4
8,109,028 B2 * 2/2012 Roberts et al. ..... 42/94
8,245,432 B2 * 8/2012 Letson ..... 42/94
8,307,576 B1 * 11/2012 Bogart et al. ..... 42/94
8,336,441 B1 * 12/2012 Javorsky ..... 89/37.03
8,356,442 B2 * 1/2013 Potterfield et al. ..... 42/94
8,448,561 B2 * 5/2013 Carroll et al. ..... 89/38
8,544,202 B2 * 10/2013 Bastian, Jr. ..... 42/94
8,578,644 B1 * 11/2013 Oquin et al. ..... 42/90
2006/0117941 A1 * 6/2006 Pacuska ..... 89/37.01
2008/0047420 A1 * 2/2008 Carroll et al. ..... 89/37.01
2008/0092732 A1 * 4/2008 Becker et al. ..... 89/37.03
2008/0202326 A1 * 8/2008 Carroll et al. ..... 89/38
2012/0325077 A1 * 12/2012 Davis et al. ..... 89/37.01
2014/0116238 A1 * 5/2014 Hagedorn et al. ..... 89/37.03

* cited by examiner

*Primary Examiner* — Michelle R Clement
(74) *Attorney, Agent, or Firm* — Kafantaris Law Offices; Theo Kafantaris

(57) ABSTRACT

The present invention will provide a flexible secondary weapon mount that can quickly and easily attach and detach to an OGPK surface and retain/eject a secondary weapon quickly and easily. Furthermore, the present invention is designed to operate with common weapon mount pintles for compatibility. This is accomplished by utilizing a base, support levers, and a ball lock retention pin for retaining he secondary mount to a surface and retaining/ejecting the secondary weapon quickly and easily.

18 Claims, 5 Drawing Sheets

SECONDARY WEAPON MOUNT

CROSS-REFERENCE TO RELATED APPLICATIONS

This application claims the benefit of U.S. Provisional Patent Application No. 61/693,989, filed on Aug. 28, 2012, and incorporated herein by reference.

STATEMENT REGARDING FEDERALLY SPONSORED RESEARCH AND DEVELOPMENT

Not Applicable.

FIELD OF THE INVENTION

This invention relates generally to a secondary weapon mount, and more particularly, to a device capable of attaching to a surface and quickly mounting and un-mounting a weapon.

DISCUSSION OF RELATED ART

A weapon mount is generally described as a component used to secure large calibre armaments such as heavy machine guns, cannons, and/or missile launchers. Typical weapon mounts include turrets, swing mounts, coaxial mounts, and ground mounts. Generally, weapon mounts are static, although they may be used on vehicles for portability.

Some weapon mounts include protection for the weapon and user, while others do not. Generally, the protection comprises a barrier between the user and the target, such as a metal shield permitting the weapon to project outward from the shield. While this system may provide adequate support for known targets, it is often necessary to protect against or attack targets which are unknown or positioned outside the optimal range of the weapon mount.

A coaxial mount is a static mount having a secondary weapon and positioned perpendicular near the main mount. The secondary weapon will generally serve to reduce the collateral damage that would occur if the main weapon was used. Furthermore, the secondary weapon may be used for additional protection against unknown targets. Primarily, this weapon mount is intended to support a secondary weapon as backup if the primary weapon should fail. If the primary weapon does fail, the gunner would then have an immediate second weapon available. Alternatively, a small machine gun may be mounted to a coaxial mount and used against targets where the main gun's power would be excessive or inefficient.

While coaxial mounts provide additional flexibility, their positions remain static, and as such, their position and flexibility are limited. Furthermore, more advanced weaponry can serve both the purpose of both the main weapon and the secondary weapon, as firepower is becoming increasingly more powerful, efficient, and contained. Therefore, a need exists for a flexible secondary weapon mount that can quickly and easily attach and detach to an OGPK surface for additional utility and firepower. The present invention satisfies these needs.

SUMMARY OF THE INVENTION

The present invention will provide a flexible secondary weapon mount that can quickly and easily attach and detach to an OGPK surface and retain/eject a secondary weapon quickly and easily. Furthermore, the present invention is designed to operate with common weapon mount pintles for compatibility. This is accomplished by utilizing a base, support levers, and a ball lock retention pin for retaining he secondary mount to a surface and retaining/ejecting the secondary weapon quickly and easily.

In the preferred embodiment, the secondary weapon mount is positioned strategically to the right or left top lip of the OGPK surface approximant to the gunner's shoulders. The primary purpose of the secondary weapon mount is to provide a second source of firepower in the unfortunate case when the primary forward weapon should fail. Furthermore, it will also cover a range or anticipated target that the main weapon mount may not be optimally suited for. As an example, a main weapon mount may be positioned to focus at an important strategic location, while the secondary weapon mount may be positioned to focus behind the user.

The secondary weapon mount comprises a base, a pair of support levers, a pintle adapter, and a release pin. The base is placed on the upper lip of the OGPK and is secured by the support levers. The weapon is attached to the pintle adapter, which is inserted into the base and secured by the ball lock release pin. When mounted, the weapon will be rotationally attached to the secondary weapon mount and can be released by removing the ball lock release pin.

These and other objectives of the present invention will become obvious to those of ordinary skill in the art after reading the following detailed description of the preferred embodiments. It is to be understood that the foregoing general description and the following detailed description are exemplary, and are intended to provide further explanation of the invention as claimed.

DETAILED DESCRIPTION OF THE PREFERRED EMBODIMENT

Figure 1:
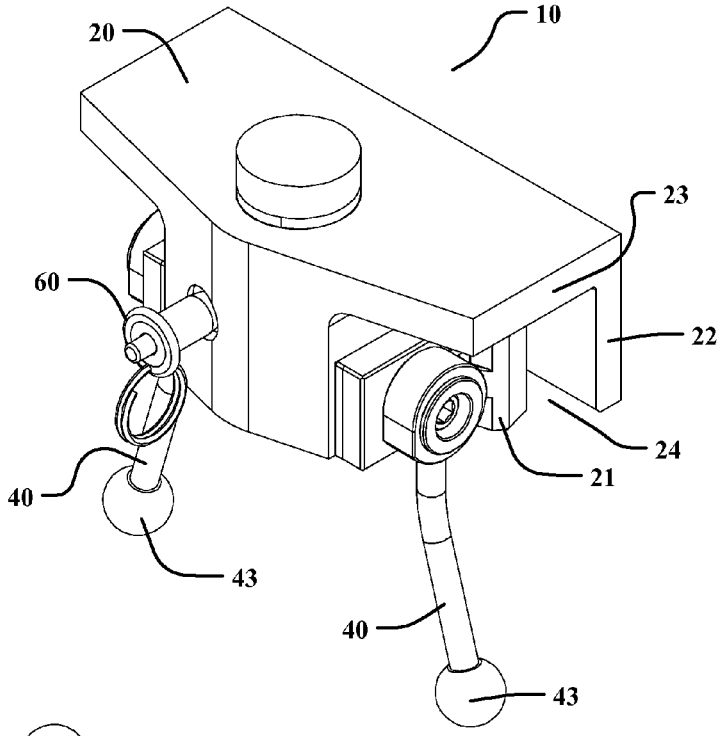
FIG. 1 is a front perspective view of the present invention.
Figure 2:
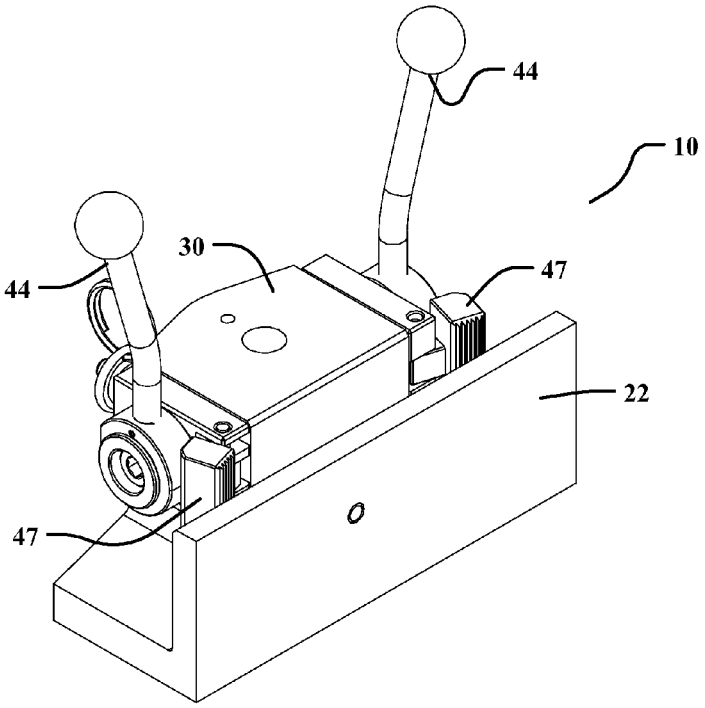
FIG. 2 is a bottom perspective view of the present invention.
Figure 3:
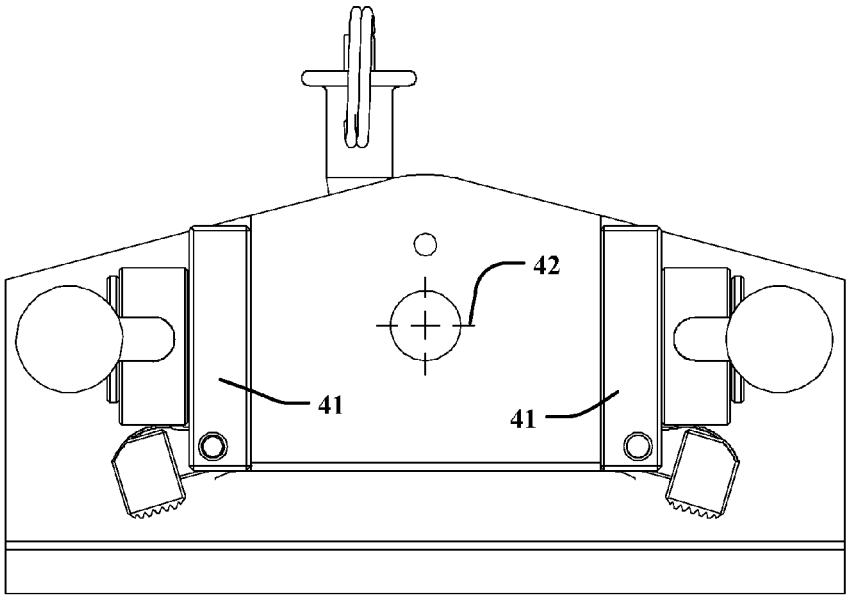
FIG. 3 is a bottom plan view of the present invention.
Figure 4:
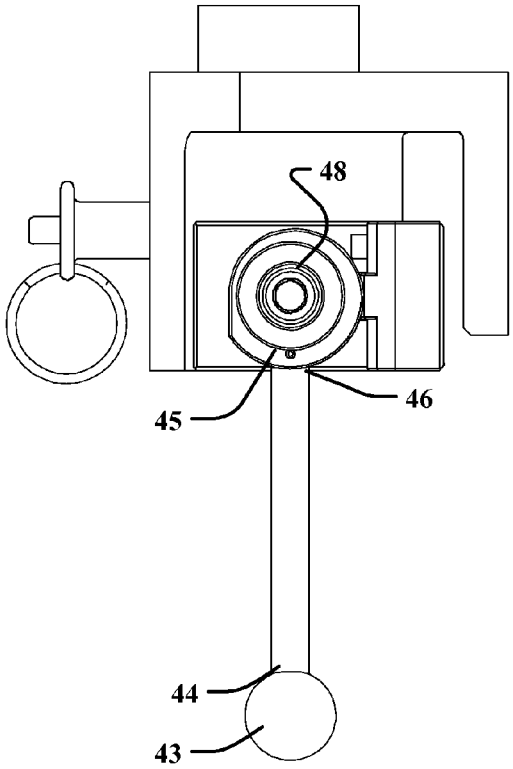
FIG. 4 is a side view of the present invention.
Figure 5:
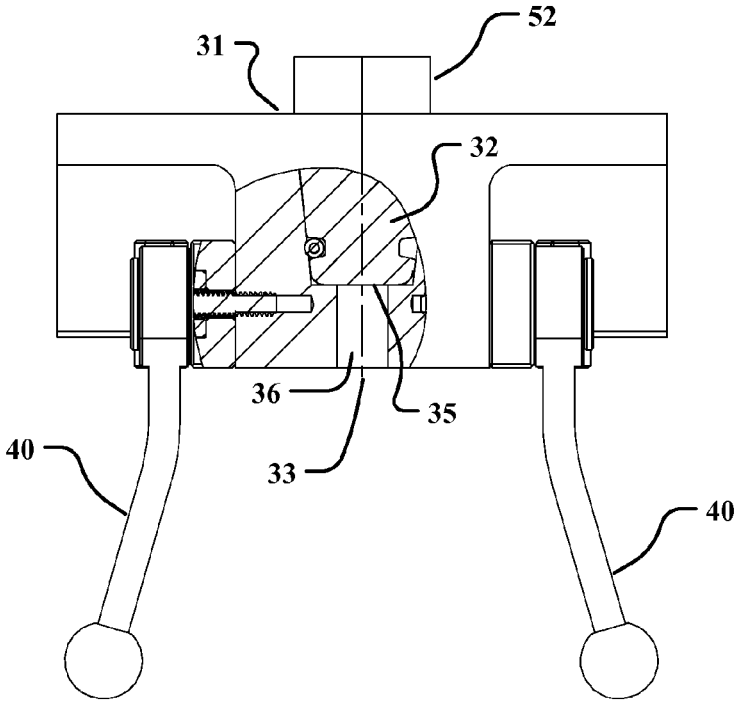
FIG. 5 is a front tear away view of the present invention.
Figure 6:
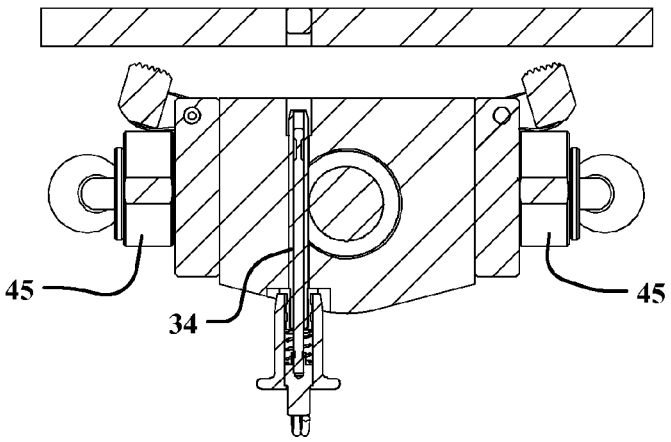
FIG. 6 is a top cross-sectional view of the present invention.
Figure 7:
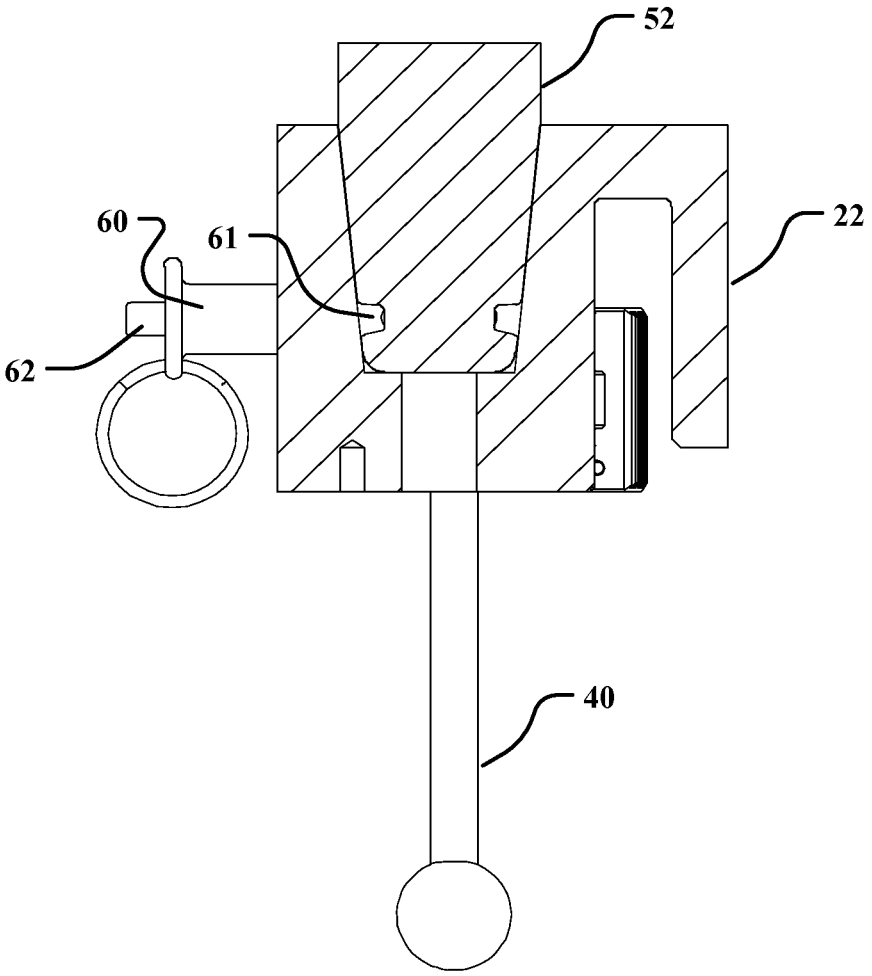
FIG. 7 is a side cross-sectional view of the present invention.
Figure 8:
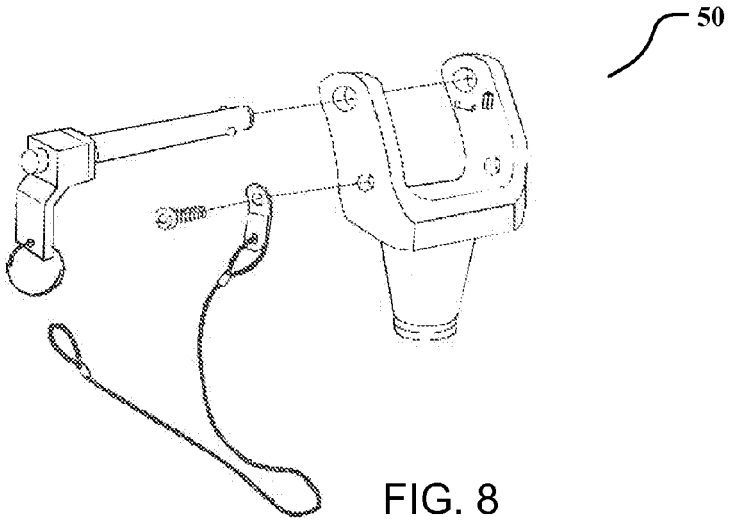
FIG. 8 is an exploded perspective view of the pintle adapter.
Figure 9:
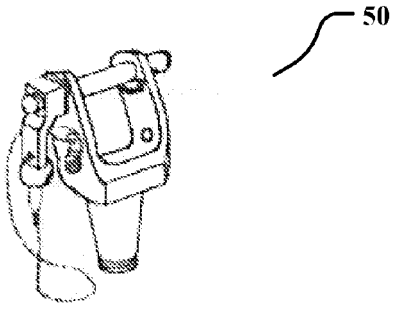
FIG. 9 is a perspective view of the pintle adapter.
Figure 10:
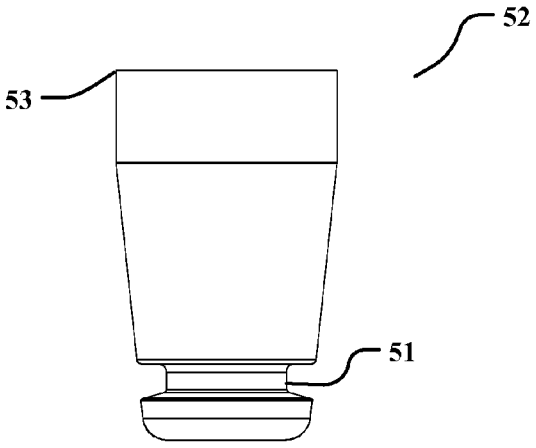
FIG. 10 is a front close-up view of the pintle adapter base.

Illustrative embodiments of the invention are described below. The following explanation provides specific details for a thorough understanding of and enabling description for these embodiments. One skilled in the art will understand that the structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The present invention discloses a secondary weapon mount 10 comprising a base 10, a pair of support levers 40, a pintle adapter 50, and a release pin 60. These components work in conjunction to provide a flexible secondary weapon mount 10 in the unfortunate event that the primary weapon would fail. Furthermore, the present invention can be repositioned simply by releasing the support levers 40 and reattaching the base 20 to an alternate location.

The base 20 comprises a first wall 21, a second wall 22, and a peripheral edge 23 defining a retention space 24. The present invention is intended to be positioned upon an OGPK turret, where the retention wall will displace the retention space 24 created by the first wall 21, second wall 22, and peripheral edge 23, thereby supporting the invention on the OGPK turret. In an alternative embodiment, a thin rubber shim (not shown) is adhered to the second wall 23 providing for a secure attachment and vibration dampening. In the preferred embodiment, steel or steel alloys are used for the base 20, although any suitable material can be used.

The base 20 further comprises a main support body 30 having a top surface 31 positioned adjacent to the peripheral edge 23. A conical frustum 32 is positioned within the main support body 30 about a vertical axis 33, wherein the conical frustum 32 is adapted to accept a pintle adapter 50. A release pin aperture 34, or ball lock release pin, is positioned near the base 35 of the conical frustum 32 and perpendicular to the vertical axis 33 such that a release pin 60 would obstruct the path of a pintle adapter 50 when inserted into the conical frustum 32. A through hole 36 is also positioned concentric with the main support body 30 and conical frustum 32 about the vertical axis 33.

A pair of support levers 40 are positioned on opposing side walls 41 of the main support body 30 about a horizontal rotational axis 42 parallel to the first 21 and second walls 22 and traveling through the main support body 30 below the conical frustum 32. Each support lever 40 further comprises a handle 43 at its proximal end 44, wherein the handles 43 are generally circular, and a support lever cam 45 at its distal end 46 concentric with the horizontal rotational axis 42. The support levers 40 are adapted to rotate within a range of up to 270 degrees.

A pair of rubber dampeners 47 are positioned adjacent to the first wall 21 and support lever cams 45 such that rotating the support levers 40 will rotate the support lever cams 45, which will drive the rubber dampeners 47 towards the second wall 22. As such, the support levers 40 and rubber dampeners 47 operate to secure the present invention to a retention wall and further dampen the vibration of the present invention when rotated into a closed position. In an alternative embodiment, the rubber dampeners 47 are pivotally attached to the first wall 21. In a further alternative embodiment, the rubber dampeners 47 are rotationally attached to the base 20. In yet a further alternative embodiment, the rubber dampeners 47 further comprise a coil spring 48 for applying forward tension to the rubber dampeners 47, thereby maintaining them in an open position until driven by the support lever cams 45.

The pintle adapter 50 is generally shaped as a conical frustum 32 having an annular groove 51 at its base 52 and adapted to accept a weapon at its top 53. The release pin aperture 34 is adapted to align with the annular groove 51 such that, when the pintle adapter 50 is placed within the conical frustum 32, a release pin 60 inserted into the release pin aperture 34 will lock the pintle adapter 50 in place by displacing the space 61 within both the release pin aperture 34 and annular groove 51. In an alternative embodiment, the release pin 60 comprises a push lock 62 or ball lock, wherein the release pin 60 cannot be removed unless the push lock 62 is depressed.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. A secondary weapon mount comprising:

a base having a first wall, a second wall, and a peripheral edge defining a retention space and further adapted to attach said secondary weapon mount to a retention wall by displacing said retention space with said retention wall;

a pair of support levers adapted to secure said base to said retention wall, wherein said base pair of support levers further comprise a rotation range of up to 270 degrees;

a pintle adapter adapted to secure a weapon; and a release pin adapted to secure said pintle adapter to said base;

wherein said secondary weapon mount can be repositioned by releasing said support levers and reattaching said base to an alternate location on said retention wall.

2. The secondary weapon mount of claim 1, wherein said base further comprises a main support body having a top surface positioned adjacent to said peripheral edge.

3. The secondary weapon mount of claim 2, wherein said main support body further comprises a conical frustum positioned about a vertical axis, wherein said conical frustum is adapted to accept a pintle adapter.

4. The secondary weapon mount of claim 3, wherein said main support body further comprises a release pin aperture positioned near the base of said conical frustum and perpendicular to the vertical axis and a release pin such that said release pin would obstruct the path of said pintle adapter when inserted into said conical frustum.

5. The secondary weapon mount of claim 4, wherein said release pin aperture is a ball lock release pin.

6. The secondary weapon mount of claim 3, wherein said main support body further comprises a through hole positioned concentric with said main support body and said conical frustum about said vertical axis.

7. The secondary weapon mount of claim 3, wherein said main support body further comprises a pair of opposing side walls about a horizontal rotational axis parallel to the first and second walls and traveling through the main support body below the conical frustum, and wherein said support levers are positioned on said opposing side walls.

8. The secondary weapon mount of claim 7, wherein said pair of support levers further comprise handles at their proximal ends and support lever cams at their distal ends concentric with the horizontal rotational axis.

9. The secondary weapon mount of claim 1, wherein said base pair of support levers further comprise a pair of rubber dampeners positioned adjacent to said first wall and support lever cams such that rotating said support levers will rotate said support lever cams, which will drive said rubber dampeners towards said second wall, wherein said support levers and said rubber dampeners operate to secure said secondary weapon mount to said retention wall and further dampen the vibration of said secondary weapon mount when said support levers are rotated into a closed position.

10. The secondary weapon mount of claim 9, wherein said rubber dampeners are pivotally attached to said first wall.

11. The secondary weapon mount of claim 9, wherein said rubber dampeners are rotationally attached to said base.

12. The secondary weapon mount of claim 9, wherein said rubber dampeners further comprise a coil spring for applying forward tension to said rubber dampeners, thereby maintaining said rubber dampeners in an open position until driven by said support lever cams.

13. The secondary weapon mount of claim 4, wherein said pintle adapter is generally shaped as a conical frustum having an annular groove at its base and adapted to accept a weapon at its top.

14. The secondary weapon mount of claim 13, wherein said release pin aperture is adapted to align with said annular groove such that, when the pintle adapter is placed within said conical frustum, a release pin inserted into said release pin aperture will lock said pintle adapter in place by displacing the space within both said release pin aperture and said annular groove.

15. The secondary weapon mount of claim 14, wherein said release pin further comprises a push lock, wherein said release pin cannot be removed unless said push lock is depressed.

16. The secondary weapon mount of claim 14, wherein said release pin further comprises a ball lock, wherein said release pin cannot be removed unless said ball lock is depressed.

17. The secondary weapon mount of claim 1, wherein said retention space further comprises a rubber shim adapted to provide vibration dampening.

18. The secondary weapon mount of claim 1, wherein said base further comprises steel or steel allows.

* * * * *